US006604746B1

(12) United States Patent
Sato et al.

(10) Patent No.: US 6,604,746 B1
(45) Date of Patent: Aug. 12, 2003

(54) SNOWBOARD BINDING

(75) Inventors: Toshiaki Sato, Tokyo (JP); Hideyuki Naito, Tokyo (JP); Yoshihiro Yagyu, Tokyo (JP); Motomu Haruna, Tokyo (JP)

(73) Assignee: Carmate Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/240,701

(22) Filed: Feb. 2, 1999

(30) Foreign Application Priority Data

Feb. 12, 1998 (JP) ..... 10-044295

(51) Int. Cl.[7] ..... A63C 9/04

(52) U.S. Cl. ..... 280/14.22; 280/619; 24/68 SK

(58) Field of Search ..... 280/619, 620, 280/622, 14.2, 617, 618, 621, 14.21, 14.22; 24/20 R, 23 W, 270, 68 SK, 307; 36/50.1, 50.5

(56) References Cited

U.S. PATENT DOCUMENTS 4,150,500 A * 4/1979 Delery ..... 36/50
4,470,175 A * 9/1984 Chiarella ..... 36/50
4,541,147 A * 9/1985 Olivieri ..... 36/50
5,261,689 A 11/1993 Carpenter et al.
5,692,765 A * 12/1997 Laughlin ..... 280/14.2
5,727,797 A * 3/1998 Bowles ..... 280/14.2
5,758,895 A * 6/1998 Bumgarner ..... 280/14.2
5,769,446 A * 6/1998 Borsoi ..... 280/623
5,820,139 A * 10/1998 Grindl ..... 280/14.2
5,852,852 A * 12/1998 Rigal ..... 24/68 R
5,857,700 A * 1/1999 Ross ..... 280/623
5,971,407 A * 10/1999 Zemke et al. ..... 280/14.2
5,975,557 A * 11/1999 Snoke et al. ..... 280/624
6,007,077 A * 12/1999 Moe ..... 280/14.2
6,027,136 A * 2/2000 Phillips ..... 280/618
6,056,300 A * 5/2000 Carpenter et al. ..... 280/14.2

* cited by examiner

*Primary Examiner*—Brian L. Johnson
*Assistant Examiner*—Jeffrey Restifo
(74) *Attorney, Agent, or Firm*—Varndell & Varndell, PLLC

(57) ABSTRACT

A snowboard binding of the invention includes: a guide unit for properly guiding a tip portion of a left band while preventing the tip portion from entering a space of a buckle; an ankle strap fitting unit for optically fastening a ankle strap around a boot; an erroneous open preventing unit for preventing a lever of a forward inclination regulation mechanism from inadvertently releasing; a retaining unit for retaining the foot in a highback; and a binding discrimination unit.

13 Claims, 11 Drawing Sheets

SNOWBOARD BINDING

BACKGROUND OF THE INVENTION

1. Field of the Invention

The invention relates to a snowboard binding.

2. Description of the Related Art

FIG. 18 is a side view showing a related snowboard binding. Reference numeral 1 designates a base plate to be fixed to a snowboard main body (not shown); 2, a boot; 3, a highback connected to the base plate 1 so as to face to a rear surface of the boot 2; 4, a pivoting support member pivotally supporting the highback 3 with respect to the base plate 1; 5, an ankle strap provided in the base plate 1 to fasten an instep portion of the boot 2; 6, a toe strap provided in the base plate 1 to fasten a toe portion of the boot 2; 7, a highback forward inclination regulation mechanism disposed on a backface of the highback 3. The lower surface of an adjuster 13 of the forward inclination regulation mechanism 7 faces to an upper surface of a rear end of a heal cup 1*a* which is located in the rearward of the base plate 1.

FIG. 19 is a view explaining the tow strap 6 in detail. Reference numeral 8*a* designates a right band fixed to a right side portion of the base plate 1 at one end thereof; 8*b*, a left band fixed to a left side portion of the base plate 1 at one end thereof; 9, a buckle attached to a free end of the right band 8*a*; 10, a ratchet belt connecting the buckle 9; 11, a lock portion having a ratchet pawl and disposed on the left band 8*b* to connect with the ratchet belt 10.

Incidentally, the ankle strap 5 has the same structure as the above toe strap 6.

In the related snowboard binding, the boot 2 is fitted to the base plate 1 as follows. Firstly, in the ankle strap 5 and the toe strap 6, the engagement between the ratchet belt 10 and the lock portion 11 with the ratchet pawl is released. After the right and left bands 8*a* and 8*b* are opened to separate from each other with both hands of a rider, the boot 2 is disposed on the base plate 1 from the above. Then, as shown in FIG. 19, the ratchet belt 10 is inserted into the lock portion 11 with the ratchet pawl and the buckle 9 is fastened, so that an inset portion and a toe portion of the boot 2 are secured to the base plate 1.

In addition, FIGS. 20 to 22 are views explaining the forward inclination regulation mechanism 7 in detail. Reference numeral 12 designates a serrated gear disposed on the backface of the highback 3; 13, an adjuster having a mating serrated gear 14 formed in the inside surface thereof, for engaging with the gear 12; 15, a pin retained in the highback 3 at one end thereof while penetrating a slit 16 located in the adjuster 13 and a hole 17 located in the highback 3; 18, an adjusting lever tiltably provided on the other end of the pin 15 via a pivotally-supporting pin and facing with the outside surface of the adjuster 13. In a state that the adjuster 13 is pressed toward the highback 3 by tilting the adjusting lever 18, as shown in FIG. 20, the gear 12 of the highback 3 and the mating gear 14 of the adjuster 13 are engaged with each other, thereby the adjuster 13 is secured to the highback 3. In this state, when the highback 3 is tilted rearward, the bottom surface of the adjuster 13 is abutted to the upper surface of the rear portion of the base plate 1, so that the tilt of the highback 3 is regulated.

However, the related snowboard binding has the following defects.

(1) When the ratchet belt 10 of the ankle strap 5 or the toe strap 6 is engaged with the lock portion 11, a tip portion 19 of the left band 8*b* generally enters the lower side of the right band 8*a* as shown in FIG. 19. However, as shown in FIG. 23, the tip portion 19 occasionally enters the upper side of the right band 8*a*. Further, the tip portion 19 enters a space 20 formed when the buckle 9 is released. Therefore, the buckle 9 cannot be fastened and the attachment of the ratchet belt 10 spends a lot of time. Additionally, if the buckle 9 is fastened in a condition that the tip portion 19 is inadvertently entered into the space 20, there is a fear that the buckle 9 is inadvertently opened in use of the binding. Therefore, there is required a technique in the attachment of the ratchet belt.

(2) Additionally, in mounting the boot 2 on the base plate 1 from the above, there is required troublesome working that the rider opens the right and left bands 8*a* and 8*b* toward the outside of the base plate 1 by both hands, respectively.

(3) Moreover, in case of fastening the ankle strap 5, as shown in FIG. 24, the fastening force is concentrated in an instep position 21. Therefore, there is a fear that the rider hurts his foot.

(4) The adjuster 13 is secured to the highback 3 by bringing down the lever 18 of the forward inclination regulation member 7, so that the inclination of the highback 3 is determined with respect to the base plate 1. However, when the lever 18 contacts with the object and the lever 18 is raised up by the impact of the contact, the adjuster 13 is moved separately from the highback 3. Therefore, there is a problem that the inclination limit angle of the highback 3 to the base plate 1 is changed.

(5) The upper end portion of the highback 3 cuts into the calf of the rider, thereby the rider has a pain.

(6) Since a lot of the same or analogous snowboard bindings exist, there is a defect that it is difficult to discriminate the snowboard binding of the self and other person.

SUMMARY OF THE INVENTION

Accordingly, an object of the invention is to provide a snowboard binding which can solve the above defects.

The present invention is characterized by the following features.

(1) A snowboard binding for securing a boot to a snowboard, includes:

a base plate adapted to be mounted onto the snowboard, the base plate having side portions; a a first band pivotally supported to one side portion of the base plate at one end thereof;

a buckle connected to the other end of the first band, the buckle having a ratchet belt;

a second band pivotally supported to the other side portion of the base plate at one end thereof; the second band having a connecting portion connectable to the ratchet belt; and a preventing unit for preventing a tip portion of the second band from entering a space when the ratchet belt is connected to the connecting portion, the space being formed between the first band and the ratchet belt when the buckle is released.

(2) A snowboard binding according to (1), wherein the preventing unit includes:

a beam extending from the other end of the first band; and a through-hole defined in the ratchet belt to inert the beam.

(3) A snowboard binding according to (2), wherein the beam has a wide portion in a tip end thereof so as to prevent the beam from coming off from the through-hole.

(4) A snowboard binding according to (1), wherein the preventing unit includes:

a tongue portion disposed in the other end of the first band, said tongue portion having a through-hole, the width of which is larger than that of the ratchet belt and is smaller than that of the other end of the second band.

(5) A snowboard binding according to (1), wherein at least one of the first and second bands has a warping portion formed by warping the band in the vicinity of the side portion of the base plate, so that the band is partially opened toward the outward of the base plate when the ratchet belt is not connected to the connecting portion.

(6) A snowboard binding according to (1), wherein at least one of the first and second bands has a lateral groove formed in the vicinity of the side portion of the base plate, so that the band is partially opened toward the outward of the base plate when the ratchet belt is not connected to the connecting portion.

(7) A snowboard binding for securing a boot to a snowboard, includes:

a base plate adapted to be mounted to the snowboard, the base plate having side portions upwardly extending therefrom;

a highback located upwardly in a rear portion of the base plate;

a first band pivotally supported to one side portion of the base plate at a support end thereof; and a second band pivotally supported to the other side portion of the base plate at a support end thereof, the second band being connectable to the first band, wherein the respective support ends of the first and second bands are disposed inside of the side portions of the base plate.

(8) A snowboard binding according to (7), wherein the respective support ends are inserted between the side portion of the base plate and the highback.

(9) A snowboard binding according to (8), further includes:

a width-adjusting member inserted between the base plate and the highback.

(10) A snowboard binding according to (9), wherein the width-adjusting member is a wedge-shaped intervening member.

(11) A snowboard binding according to (9), wherein the width-adjusting member includes a screw threaded in the side portion of the base plate so as to be movable toward the highback.

(12) A snowboard binding according to (9), wherein the width-adjusting member is integrally formed with the support end of the band.

(13) A snowboard binding according to (7), wherein the respective support ends of the first and second bands are disposed inside of the highback.

(14) A snowboard binding for securing a boot to a snowboard, includes:

a base plate adapted to be mounted to the snowboard, the base plate having side portions upwardly extending therefrom and a back portion connected to rear portions of the respective side portions;

a highback located upward of the back portion of the base plate; and a forward inclination regulation portion disposed on a backface of the highback, for regulating the inclination of the highback, the forward inclination regulation portion including:

a serration formed in the backface of the highback;

an adjuster having an inside surface with a mating serration engagable with the serration of the highback and a bottom surface abuttable to an upper surface of the back portion of the base plate; and a lever tiltably disposed on the backface of the highback, for securing the adjuster to the highback at an arbitrary height position, wherein the adjuster has a recess portion receiving the lever when the lever is tilted.

(15) A snowboard binding according to (14), wherein a tip portion of the lever is interposed between the base plate and the highback when the lever is tilted.

(16) A snowboard binding for securing a boot to a snowboard, includes:

a base plate adapted to be mounted to the snowboard, the base plate having side portions upwardly extending therefrom; and a highback located upwardly in a rear portion of the base plate; the highback including:

a lower highback pivotally supported to the side portions of the base plate at a base portion thereof; and an upper highback tiltably supported to an upper portion of the lower highback at a lower portion thereof.

(17) A snowboard binding for securing a boot to a snowboard, includes:

a base plate adapted to be mounted to the snowboard, the base plate having side portions upwardly extending therefrom; and a highback located upwardly in a rear portion of the base plate; the highback including:

a lower highback pivotally supported to the side portions of the base plate at a base portion thereof; and the upper highback attached to the lower highback so as to adjust the height of the upper highback with respect to the lower highback.

(18) A snowboard binding for securing a boot to a snowboard includes:

a base plate adapted to be mounted to the snowboard;

a highback located upwardly in a rear portion of the base plate; and a transparent member attached to at least one of the base plate and highback, so as to interpose a picture or the like therebetween.

DETAILED DESCRIPTION OF THE PREFERRED EMBODIMENTS

Figure 1:
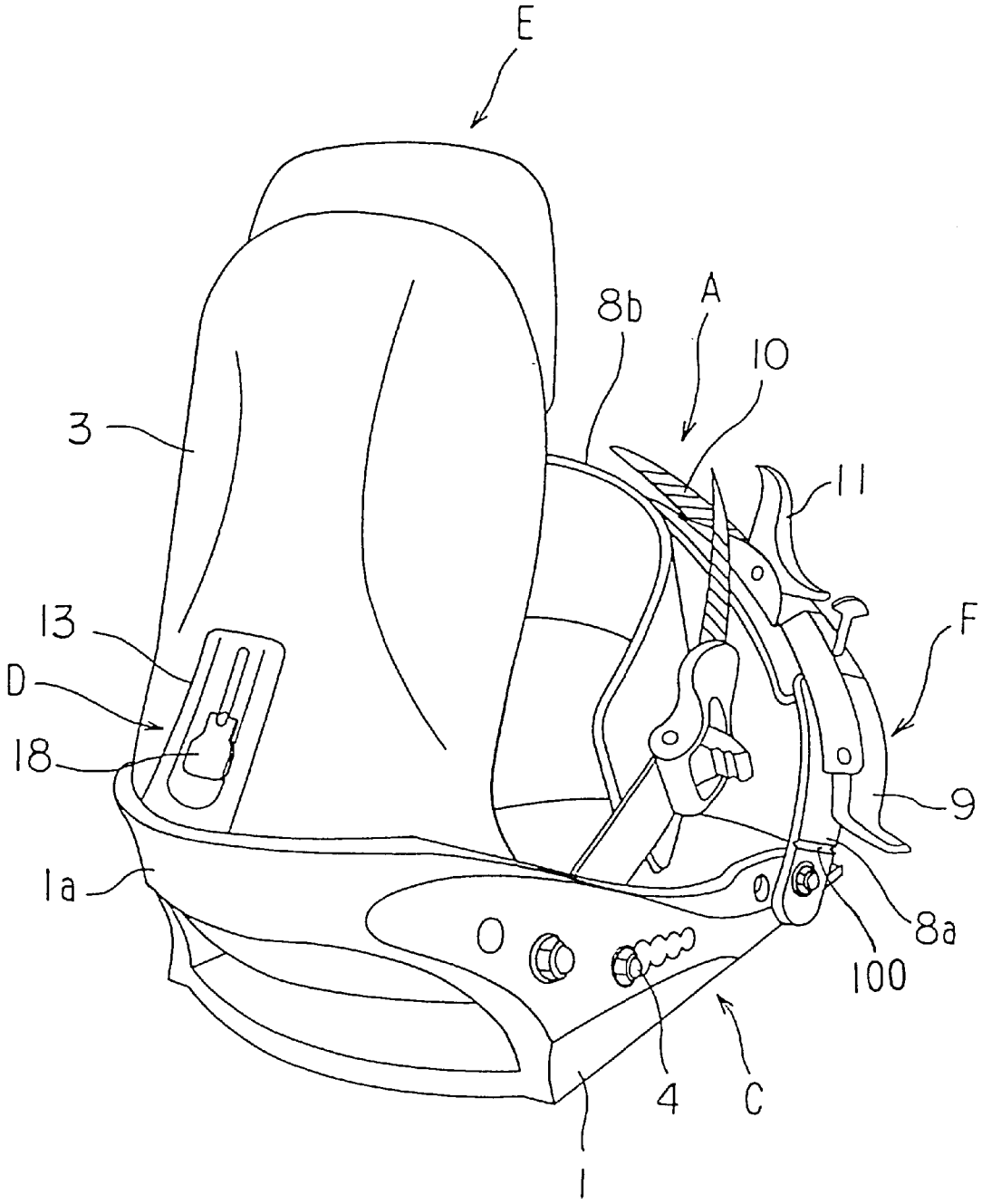
FIG. 1 is a perspective view of a snowboard binding of the present invention.

Referring to the drawings, a description will be given in detail of the embodiments of the invention. The portions corresponding to these in the Related Art are designated by the same reference numerals.

As shown in FIG. 1, a snowboard binding of the invention includes: a guide unit A for properly guiding a tip portion 19 of a left band 8*b* while preventing the tip portion 19 from entering a space 20 of a buckle 9; an ankle strap fitting unit C for optically fastening a ankle strap 5 around a boot 2; an erroneous open preventing unit D for preventing a lever 18 of a forward inclination regulation mechanism 7 from inadvertently releasing; a retaining unit E for retaining the foot in a highback 3; and a binding discrimination unit F.

Figure 2:
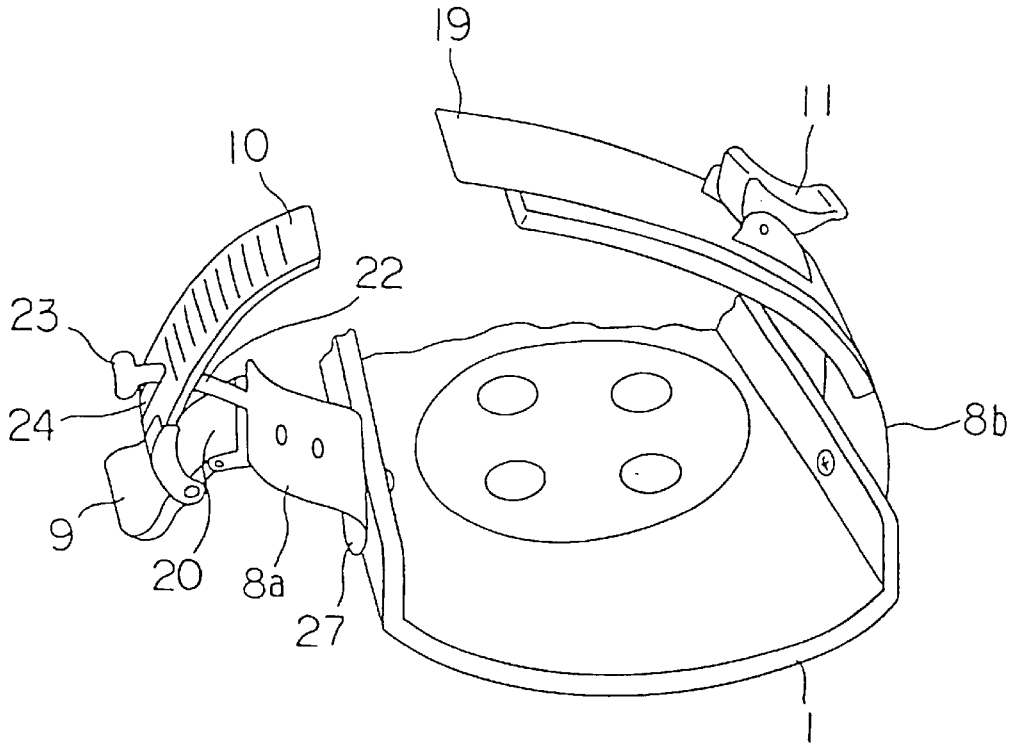
FIG. 2 is a perspective view explaining a band guide unit and a warp portion of the snowboard binding of the present invention.
Figure 3:
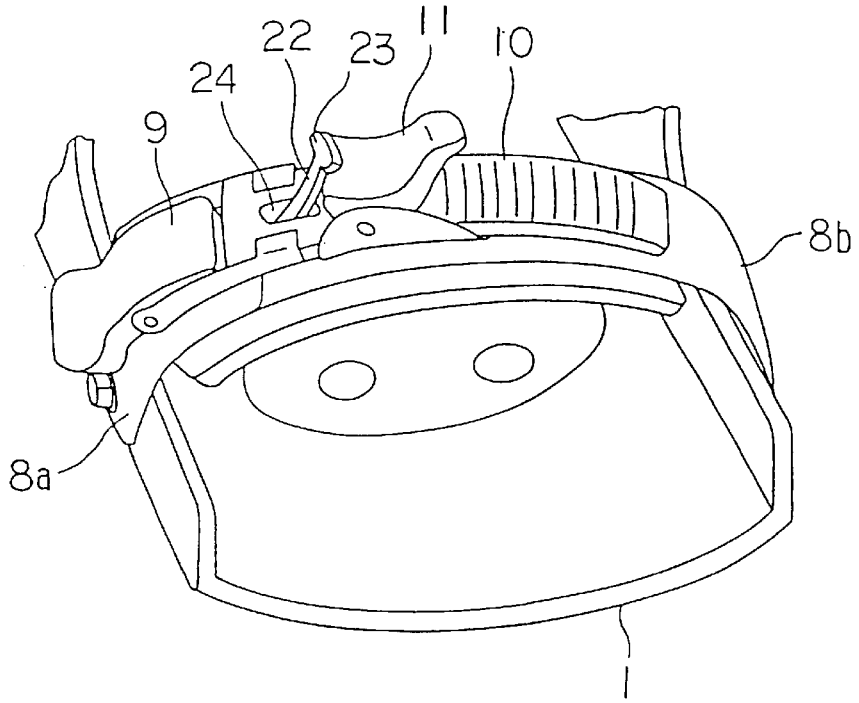
FIG. 3 is a perspective view explaining the guide unit and the warp portion of the snowboard binding of the present invention.

As shown in FIGS. 2 and 3, the guide unit A includes a T-like beam 22 and a through hole 24 of a ratchet belt 10. The T-like beam 22 is disposed on the tip end of the right band 8*a* of the toe strap 6. The through hole 24 is disposed on the base side of the ratchet belt 10 to be passed through a head portion 23 of the T-like beam 22 from the lower side toward the upper side of the ratchet belt 10.

In this connection, the guide unit A may be applied to the ankle strap 5.

With the guide unit A thus structured, when the ratchet belt 10 is engaged with a lock portion 11, the tip portion 19 of the left band 8*b* is interrupted by the T-like beam 22 so as not to enter the space 20 formed when the buckle 9 is released. Then, the tip portion 19 is certainly guided toward the low side of the right band 8*a* by the guide unit A. Accordingly, a rider does not need to care about the attachment of the toe strap 6 or the like and can conduct the attachment thereof quickly without the knack.

Figure 4:
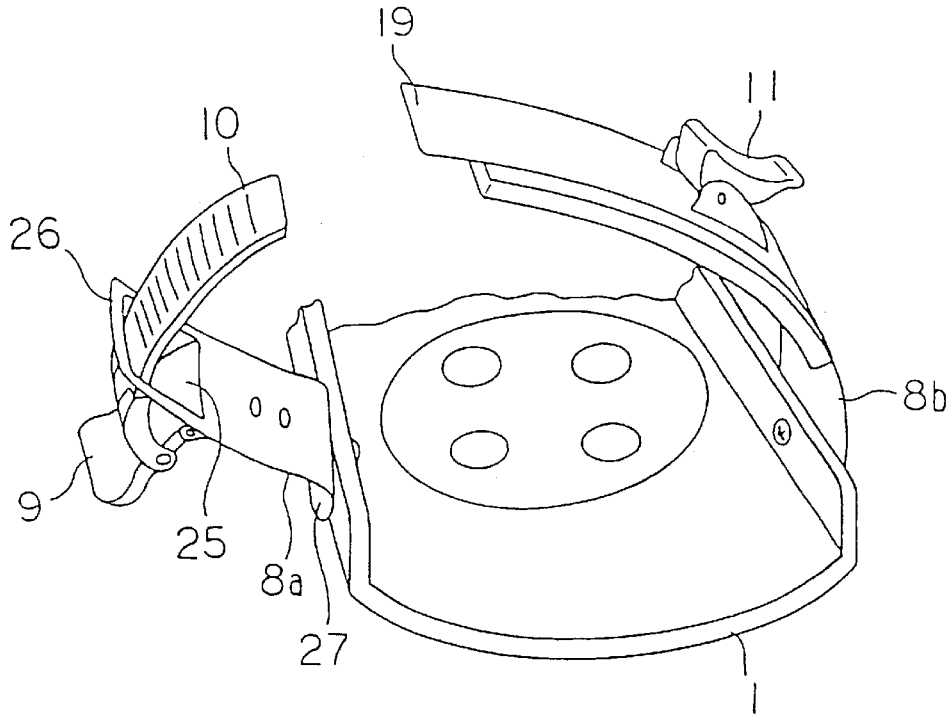
FIG. 4 is a perspective view explaining another embodiment of the guide unit and the warp portion of the snowboard binding of the present invention.

FIG. 4 shows another embodiment of the guide unit A. In this embodiment, a tongue portion 26 with a through-hole 25 is provided in the tip end portion of the right band 8*a*. The width of the through-hole 25 is larger than that of the ratchet belt 10 but is smaller than that of the left band 8*b*. The ratchet belt 10 is penetrated into the through hole 25.

In this embodiment, as well, when the ratchet belt 10 is engaged with the lock portion 11, the tip portion 19 of the left band 8*b* is interrupted by the T-like beam 22, so as not to enter the space 20 formed when the buckle 9 is released. Then, the tip portion 19 is certainly guided by the guide unit A toward the low side of the one band 8*a*.

In FIG. 2, the right band 8*a* includes a warp portion 27 which is formed on a base portion of the right band 8*a* and is warped outwardly of the base plate 1.

Due to the warp portion 27 thus structured, in a condition that the attachment of the ratchet belt 10 and the lock portion 11 of the toe strap 6 is released, the right band 8*a* is always opened outwardly of the base plate 1. Accordingly, the rider can easily mount the boot 2 on the base plate 1 from the above without forcibly opening with his hands. It is needless to say that it is more preferable to form the warp portion 27 in a base portion of the left band 8*b* as well. Further, the warp portion 27 may be applied to the ankle strap 5.

In this condition, in spite of forming the warp portion 27, there maybe formed a lateral groove 100 on an outside surface of the base portion of the band so as to outwardly bend the band at a position where the groove is formed, as shown in FIG. 1.

Figure 5:
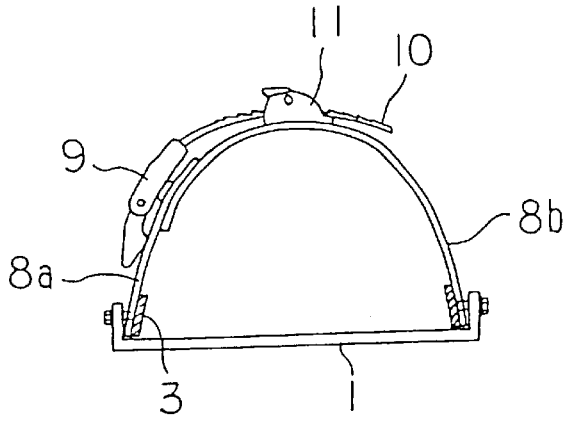
FIG. 5 is a front view explaining an ankle strap fitting unit of the snowboard binding of the present invention.

In the fitting unit C, in spite of pivotally supporting the respective base portions of the right and left bands 8*a*, 8*b* of the ankle strap 5 to the outer surface of a heel cup 1*a* or side portions of the base plate 1, as shown in FIG. 5, the base portions of the right and left bands 8*a*, 8*b* are disposed between the outer surface of the highback 3 and the inner surface of the heel cup 1*a* to tiltably and pivotally support the bands 8*a*, 8*b* to the heel cup 1*a* via a support pin 28.

According to the fitting unit C, in case of fastening the ankle strap 5 as shown in FIG. 5, the highback 3 is deformed inside and the instep portion of the highback 3 makes narrow in width, whereby not only the holding property of the ankle of the boot 2 is increased by means of the highback 3, but also a contact area between the ankle strap 5 and the boot 2 are increased as compared with the related art. Accordingly, the fastening force is dispersed and the pain of the foot can be relieved.

Figure 6:
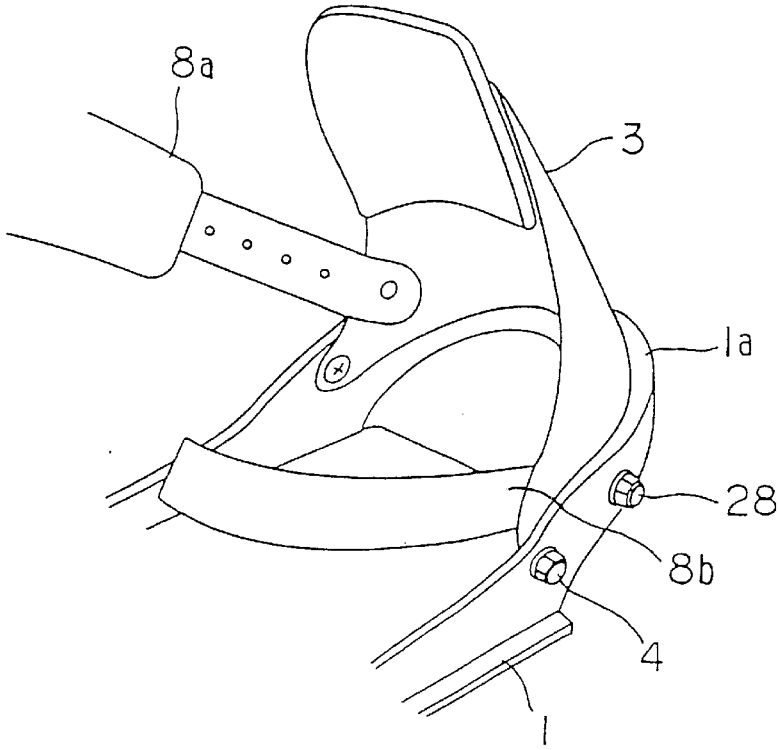
FIG. 6 is a perspective view explaining the ankle strap fitting unit of the snowboard binding of the present invention.

Incidentally, as shown in FIG. 6, the base portions of the right and left bands 8*a*, 8*b* of the ankle strap 5 may be disposed inside the highback 3 and the support pin 28 may be inserted into the heel cup 1*a* through holes of the base portion and the highback 3. In this case, since a contact area between the ankle strap 5 and the boot 2 is further increased, the pain of the foot can be relieved.

Figure 7:
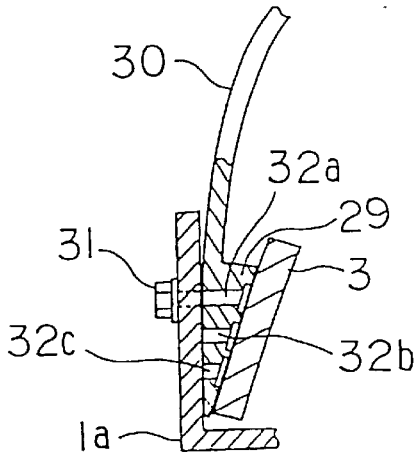
FIG. 7 is a cross-sectional view explaining another embodiment of the ankle strap fitting unit of the snowboard binding of the present invention.

FIG. 7 shows still another embodiment of the fitting unit C. In this embodiment, there is provided a right or left band 30 having a base portion 29 formed in a wedge-shape so as to get thinner toward the tip end thereof. The base portion 29 is pivotally and tiltably supported to the heel cup 1*a* of the base plate 1 via a support pin 31. Moreover, in the base portion 29, there is provided a plurality of through-holes 32*a*, 32*b*, 32*c* for the support pin 31 in a state that they are vertically separated from each other.

Figure 8:
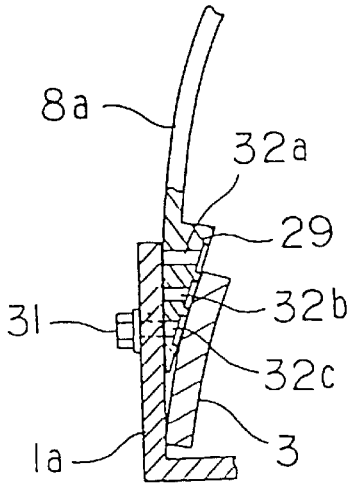
FIG. 8 is a cross-sectional view explaining another embodiment of the ankle strap fitting unit of the snowboard binding of the present invention.

In this embodiment, when the width of the boot 2 is somewhat small as compared with that of the heel cup 1*a*, the base portion 29 is pivotally supported to the heel cup 1*a* by inserting the support pin 31 into the uppermost thicker through-hole 32*a*, as shown in FIG. 7. Accordingly, the highback 3 is somewhat moved inside, so as to make the width of the highback 3 narrow and fit the boot 2 with the highback 3. On the other hand, when the width of the boot 2 is substantially equal to that of the heel cup 1*a*, the base portion 29 is pivotally supported to the heel cup 1*a* with the lowermost thinner through-hole 32*c*, as shown in FIG. 8. Accordingly, the boot 2 can be fitted with the highback 3 without the play of the boot 2 in the inside of the highback 3. As described the above, this embodiment can adjust the heel width of the binding in accordance with the heel of the boot 2.

Figure 9:
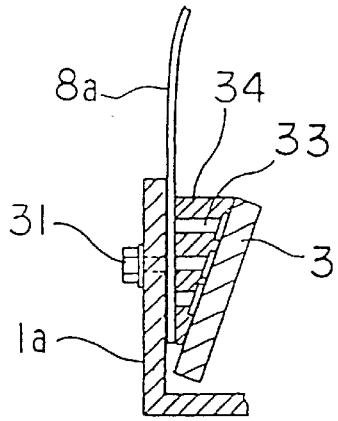
FIG. 9 is a cross-sectional view explaining still another embodiment of the ankle strap fitting unit of the snowboard binding of the present invention.

As shown in FIG. 9, there may be separately provided a wedge-shaped intervening member 34 having a plurality of through-holes 33, and the intervening member 34 may be intervened between the heel cup 1*a* and the highback 3, so as to adjust the heel width of the binding.

Figure 10:
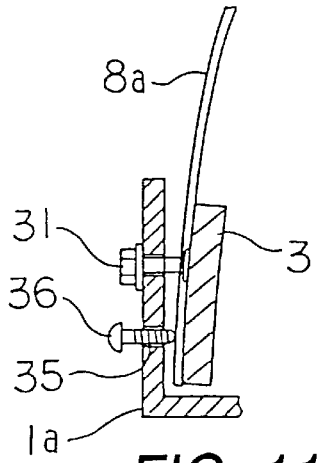
FIG. 10 is a cross-sectional view explaining further still another embodiment of the ankle strap fitting unit of the snowboard binding of the present invention.

In addition, as shown in FIG. 10, there may be provided a screw hole 35 in the heel cup 1*a* and a screw 36 for pressing he highback 3 may be threaded into the screw hole 35 from the outer surface of the heel cup 1*a* toward the highback 3. With his structure, the highback 3 can be moved inside with respect to the heel cup 1*a*.

Figure 11:
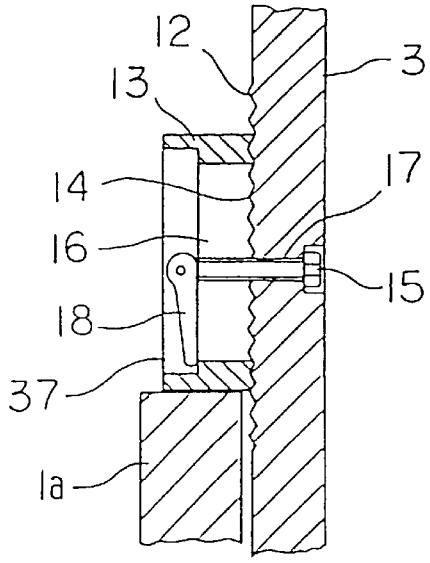
FIG. 11 is a cross-sectional view explaining an erroneous open preventing unit of the snowboard binding of the present invention.

As shown in FIG. 11, the erroneous open preventing unit D is structured in such a manner that a recess portion 37 is provided in the outside surface of the adjuster 13, and the lever 18 is disposed within the recess portion 37 when the lever 18 is tilted.

With the erroneous open preventing unit D, when the lever 18 is tilted, the lever 18 is disposed within the adjuster 13. Therefore, the object or the like does not contact with the lever 18 even in the overturn and the other case. Accordingly, the fix between the adjuster 13 and the highback 3 is not released.

Figure 12:
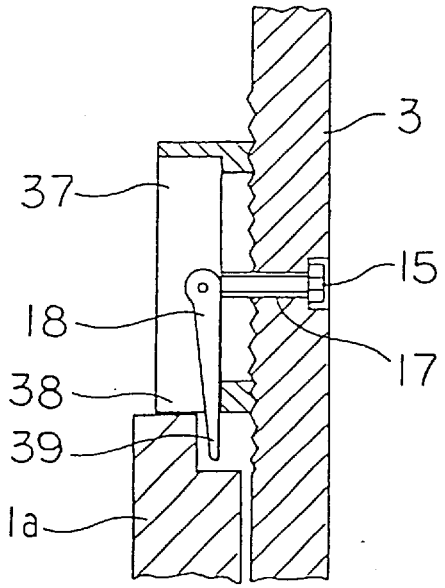
FIG. 12 is a cross-sectional view explaining another embodiment of the erroneous open preventing unit of the snowboard binding of the present invention.

FIG. 12 shows another embodiment of the erroneous open preventing unit D. In this embodiment, there are provided a cut portion 38 in the outside bottom surface of the adjuster 13 and an elongating portion 39 in the tip portion of the lever 18. When the lever 18 is tilted downward in order to fix the adjuster 13 into the highback 3, the elongating portion 39 of the lever 18 is projected outside via the cut portion 38 of the adjuster 13 and the elongating portion 39 is received between the heel cup 1*a* and the highback 3.

Accordingly, this embodiment can also prevent the lever 18 from opening erroneously.

Figure 13:
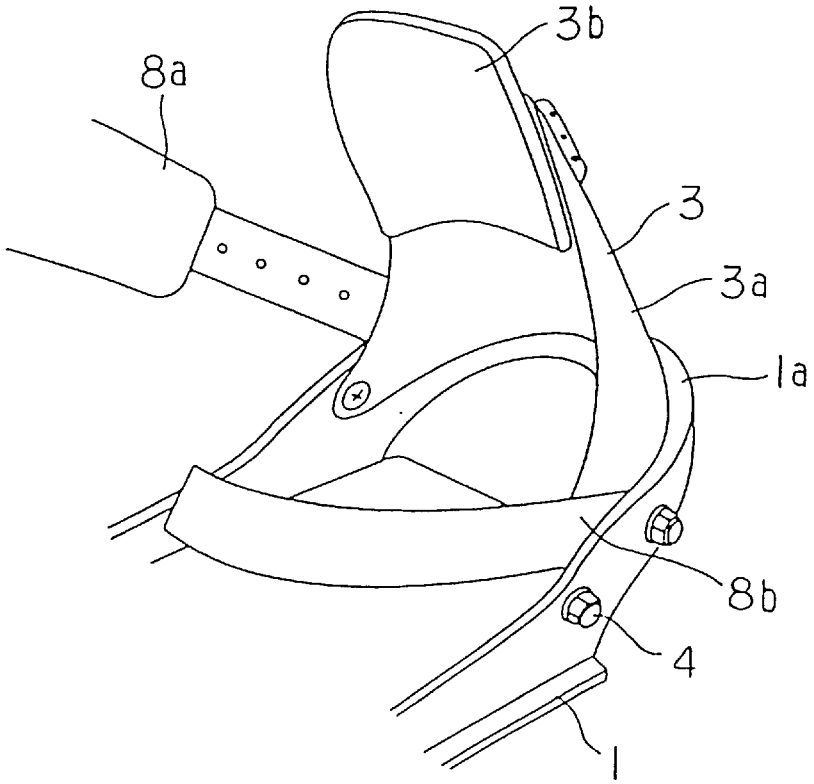
FIG. 13 is a perspective view explaining a retaining unit of the foot of the snowboard binding of the present invention.
Figure 14:
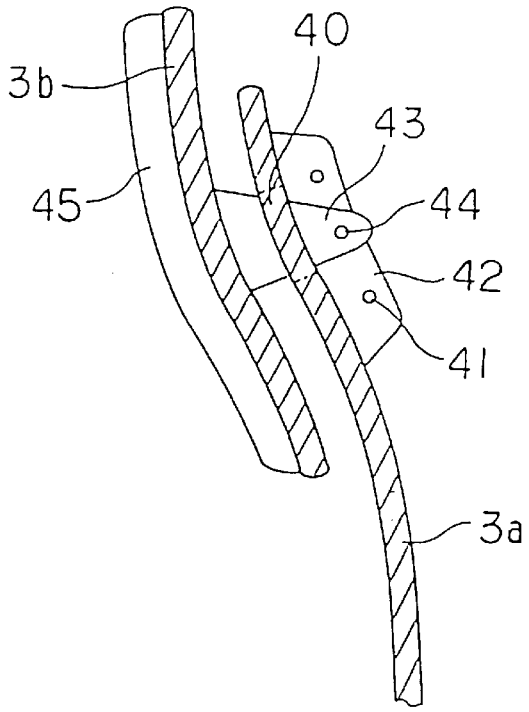
FIG. 14 is a cross-sectional view explaining the retaining unit of the snowboard binding of the present invention.

In the retaining unit E, the highback 3 is devided into a lower highback 3*a* and an upper highback 3*b*, as shown in FIGS. 13 and 14. Further, in the upper portion of the lower highback 3*a*, there are provided with a vertical slit 40 and one connecting plate 42 with a plurality of pivotally support holes 41 vertically separated from each other. The other connecting plate 43 is projected from the outer surface of the lower portion of the upper highback 3*b*. The slit 40 and the one connecting plate 42 are located in the lower portion of the upper highback 3*b*. The other connecting plate 43 penetrates the slit 40 and is connected and fixed with the one connecting plate 42 of the lower highback 3*b* via the arbitrary pivotally support hole 41 by means of a rivet 44.

With the retaining unit E thus structured, the upper highback 3*b* is tilted relative to the lower highback 3*a* along a calf portion of the boot 2 and a highback cushion 45 attached to the upper highback 3*b* is uniformly pressed by the foot of the rider, so as to improve the fitting feeling and prevent the pain of the foot.

In addition, since the height of the upper highback 3*b* can be changed by selecting the connecting position of the rivet 44 with the pivotally support hole 41, so as to adjust the upper highback 3*b* at the preferable position in accordance with the length of the foot, the development of the muscle of the calf, young and old of both sexes, all kinds of person.

Figure 15:
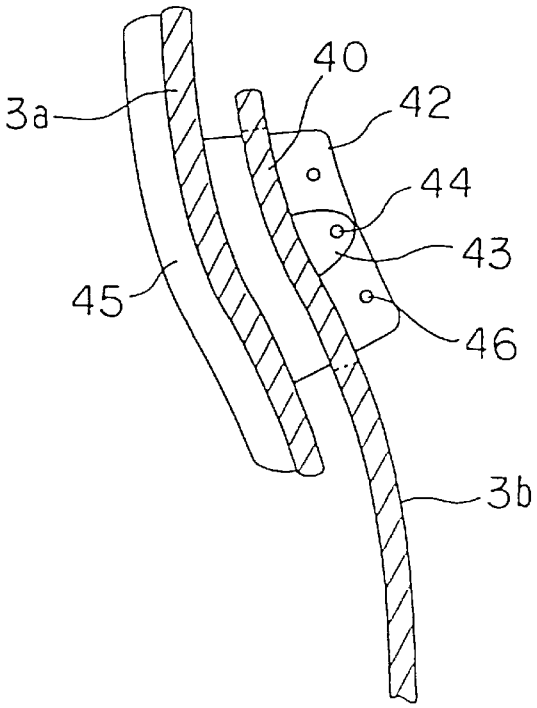
FIG. 15 is a cross-sectional view explaining another embodiment of the retaining unit of the snowboard binding of the present invention.

Incidentally, as shown in FIG. 15, a plurality of pivotally support holes 46 may be disposed in the other connecting plate 43 of the upper highback 3*b*, and the other connecting plate 43 may be pivotally and tiltably supported to the one connecting plate 42 of the lower highback 3*a*.

Figure 16:
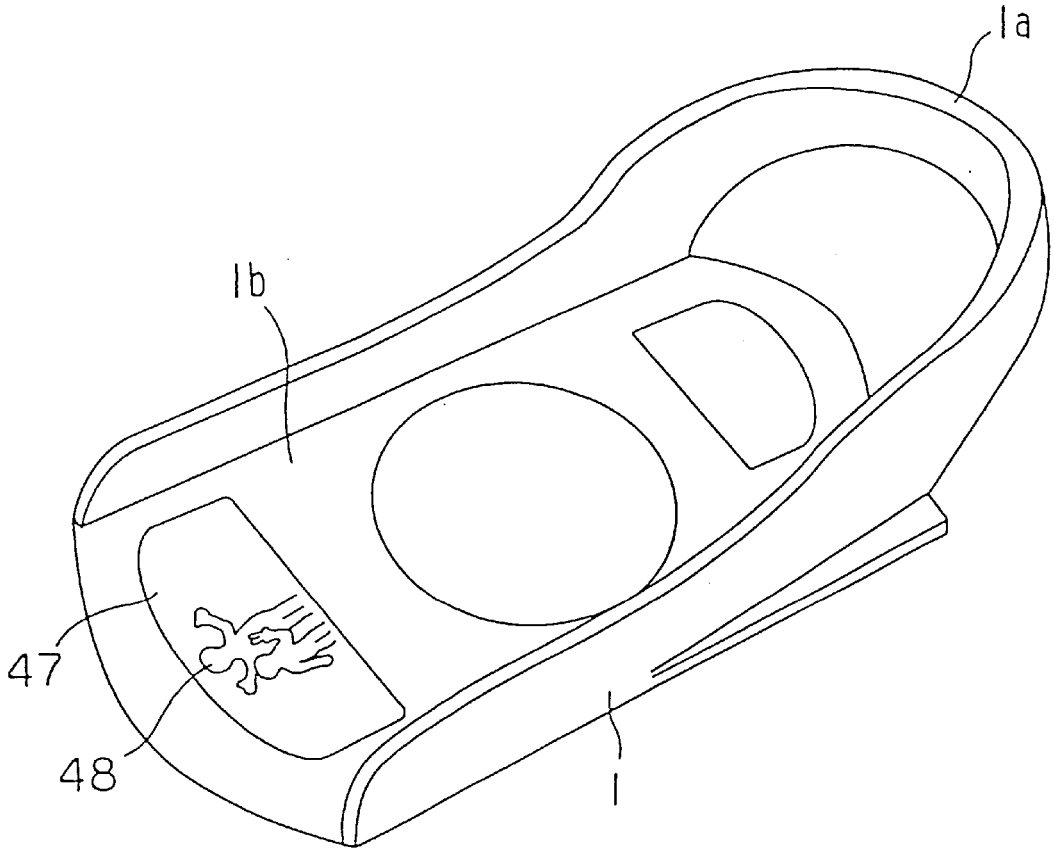
FIG. 16 is a perspective view explaining a snowboard discrimination unit of the snowboard binding of the present invention.

In the binding discrimination unit F, as shown in FIG. 16, a transparent cover 47 is mounted on an upper surface 1*b* of the base plate 1, so as to interpose a picture, a seal 48, or the like between the transparent cover 47 and the base plate 1. The transparent cover 47 may be mounted on a back surface of the highback 3, or the like.

Incidentally, the transparent cover 47 is directly fixed to the base plate 1 by means of an adhesive, or is fixed to a recess portion formed in the base plate 1 by means of an adhesive, an insertion, a screw, or the like.

The binding discrimination unit F can prevent the picture or the like from getting wet, wearing or coming off. Further, the binding discrimination unit F can improve the individuality, so that the discrimination from the other binding, the improvement of the appeal, the theft prevention and the like are obtained.

Incidentally, the transparent cover 47 may be made of hard material or material having a good cushion property.

Further, the shape of the transparent cover 47 may be formed in the sole shape of the boot 2, so as to allow the boot 2 to fit with the binding.

Figure 17:
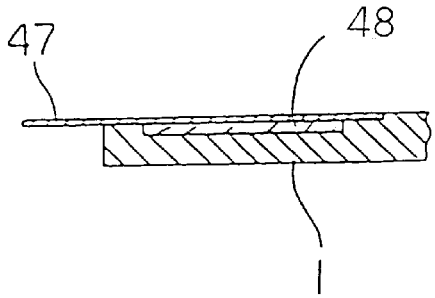
FIG. 17 is a cross-sectional view explaining another embodiment of the discrimination unit of the snowboard binding of the present invention.
Figure 18:
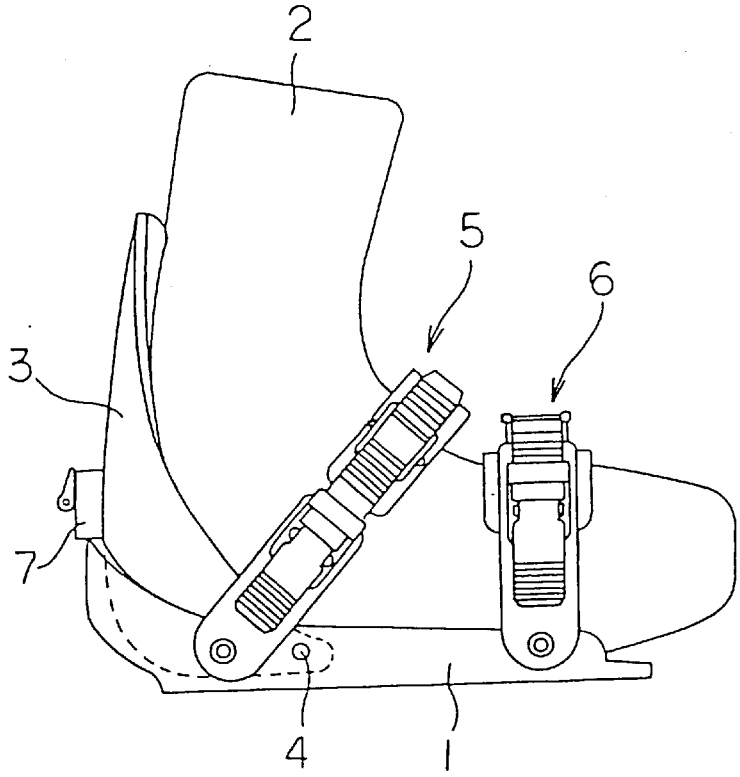
FIG. 18 is a side view of the related snowboard binding.
Figure 19:
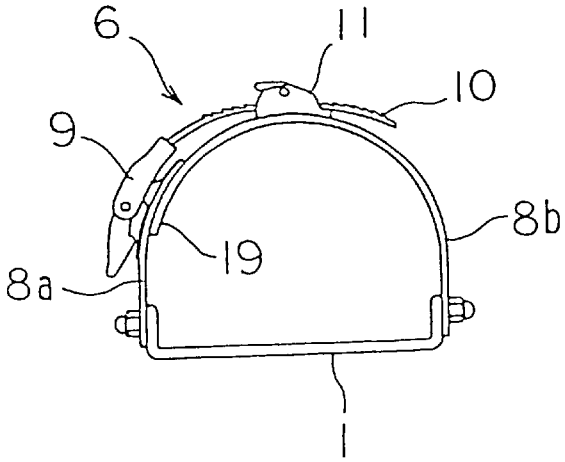
FIG. 19 is a front view of the related snowboard binding.
Figure 20:
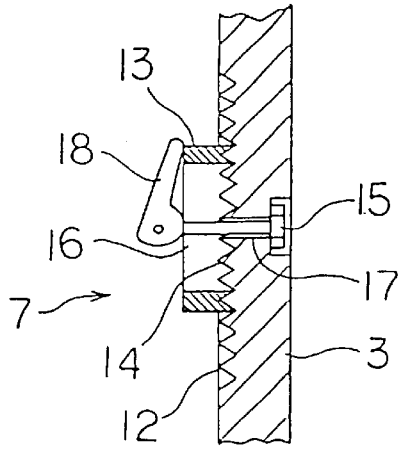
FIG. 20 is a cross-sectional view explaining a forward inclination regulation member of the related snowboard binding.
Figure 21:
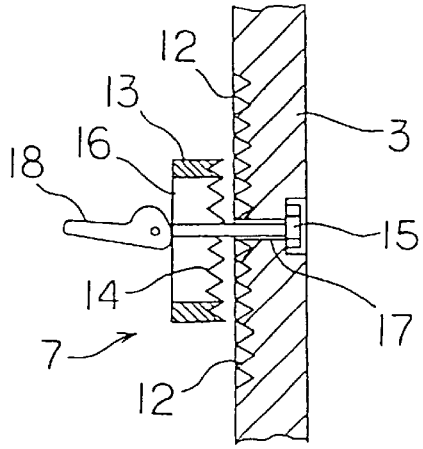
FIG. 21 is a cross-sectional view explaining the forward inclination regulation member of the related snowboard binding.
Figure 22:
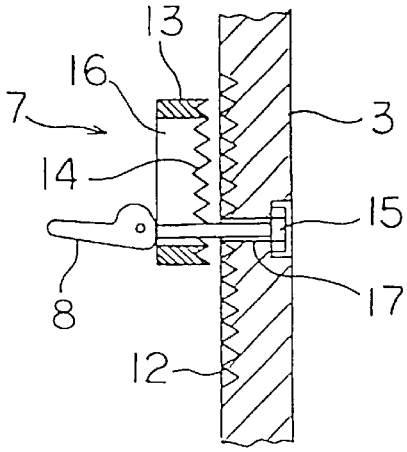
FIG. 22 is a cross-sectional view explaining the forward inclination regulation member of the related snowboard binding.
Figure 23:
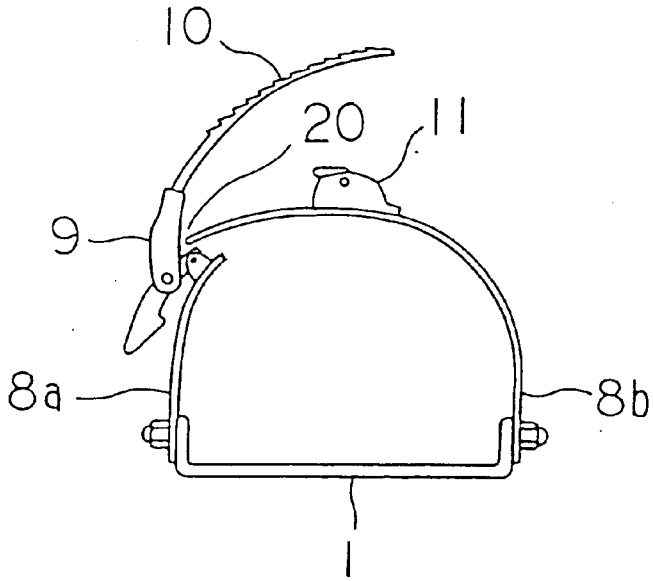
FIG. 23 is a front view explaining the related snowboard binding.
Figure 24:
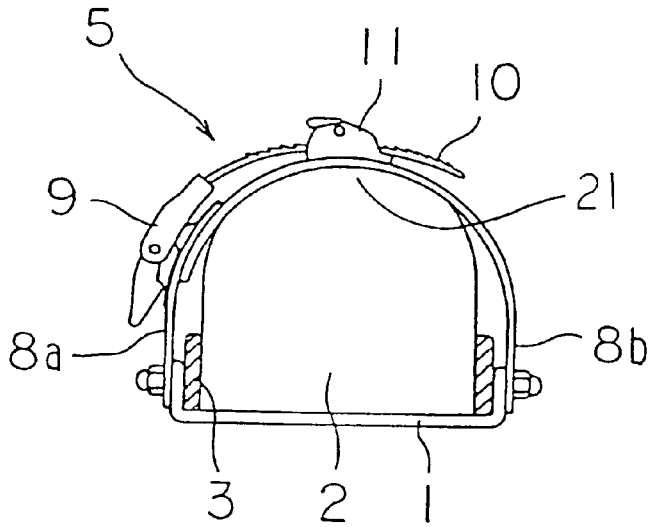
FIG. 24 is a front view explaining the related snowboard binding.

Incidentally, as shown in FIG. 17, the transparent cover 47 may be projected outwardly from the forward or rearward of the base plate 1. This structure not only interposes the picture 48 or the like, but also holds the front end portion or the rear end portion of the boot 2 by the projected portion of the transparent cover 47, to thereby improve the fitting feeling of the boot 2.

As described the above, the snowboard binding of the present invention has much merit so as to enhance not only the installation property, but also the safety, the theft prevention, and the like.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modification may be made thereto without departing from the spirit and scope of the invention.

What is claimed is:

1. A snowboard binding for securing a boot to a snowboard, comprising:

a base plate adapted to be mounted onto the snowboard, said base plate having side portions;

a first band pivotally supported to one side portion of said base plate at one end thereof;

a buckle connected to the other end of said first band, said buckle having a ratchet belt;

a second band pivotally supported to the other side portion of said base plate at one end thereof; said second band having a connecting portion connectable to said ratchet belt; and means arranged within said first band, including T-shaped structure, for preventing a tip portion of said second band from entering a space when said ratchet belt is connected to said connecting portion, the space being formed between said first band and said ratchet belt when said buckle is released.

2. A snowboard binding according to claim 1, wherein said preventing means comprises:

a beam extending from the other end of said first band; and a through-hole defined in said ratchet belt to inert said beam.

3. A snowboard binding according to claim 2, wherein said beam has a wide portion in a tip end thereof so as to prevent the beam from coming off from said through-hole.

4. A snowboard binding according to claim 1, wherein the preventing means comprises:

a tongue portion disposed in the other end of said first band, said tongue portion having a through-hole, the width of which is larger than that of said ratchet belt and is smaller than that of the other end of said second band.

5. A snowboard binding according to claim 1, wherein at least one of said first and second bands has a warping portion formed by warping said band in the vicinity of the side portion of said base plate, so that said band is partially opened toward the outward of said base plate when said ratchet belt is not connected to said connecting portion.

6. A snowboard binding according to claim 1, wherein at least one of said first and second bands has a lateral groove formed in the vicinity of the side portion of said base plate, so that said band is partially opened toward the outward of said base plate when said ratchet belt is not connected to said connecting portion.

7. A snowboard binding according to claim 1, wherein said tip portion of said second band is contactable with said first band, when said buckle is fastened.

8. A snowboard binding for securing a boot to a snowboard, comprising:

a base plate adapted to be mounted to the snowboard, said base plate having side portions upwardly extending therefrom;

a highback located upwardly in a rear portion of said base plate;

a first band pivotally supported to one side portion of said base plate at a support end thereof; and a second band pivotally supported to the other side portion of said base plate at a support end thereof, said second band being connectable to said first band, wherein the respective support ends of said first and second bands are disposed inside of the side portions of said base plate and between the side portion of said base plate and said highback.

9. A snowboard binding according to claim 8, further comprising:

a width adjusting member inserted between the base plate and the highback.

10. A snowboard binding according to claim 9, wherein the width adjusting member is a wedge-shaped intervening member.

11. A snowboard binding according to claim 9, wherein said width adjusting member comprises a screw threaded in the side portion of said base plate so as to be movable toward said highback.

12. A snowboard binding according to claim 9, wherein said width adjusting member is integrally formed with the support end of said band.

13. A snowboard binding for securing a boot to a snowboard, comprising:

a base plate adapted to be mounted to the snowboard, said base plate being integrally formed and having a bottom portion and side portions, said side portions upwardly extending from said bottom portion, and said side portions including a heel cup;

a highback extending upwardly from and pivotally joined to said heel cup of said base plate;

a first band pivotally supported to one side portion of said base plate at a support end thereof; and a second band pivotally supported to the other side portion of said base plate at a support end thereof, said second band being connectable to said first band, wherein the respective support ends of said first and second bands are disposed between said side portions of said base plate and said highback.

* * * * *